US010982307B2

(12) United States Patent
Kümmel et al.

(10) Patent No.: US 10,982,307 B2
(45) Date of Patent: Apr. 20, 2021

(54) METHOD FOR OPERATING A COATING DEVICE FOR COATING A METAL STRIP, AND COATING DEVICE

(71) Applicant: FONTAINE ENGINEERING UND MASCHINEN GMBH, Langenfeld (DE)

(72) Inventors: Lutz Kümmel, Jüchen (DE); Thomas Daube, Duisburg (DE); Holger Behrens, Erkrath (DE); Dominique Fontaine, Langenfeld (DE); Michael Zielenbach, Siegen (DE)

(73) Assignee: FONTAINE ENGINEERING UND MASCHINEN GMBH, Langenfeld (DE)

( * ) Notice: Subject to any disclaimer, the term of this patent is extended or adjusted under 35 U.S.C. 154(b) by 0 days.

(21) Appl. No.: 16/079,486

(22) PCT Filed: Jan. 13, 2017

(86) PCT No.: PCT/EP2017/050660
§ 371 (c)(1),
(2) Date: Aug. 23, 2018

(87) PCT Pub. No.: WO2017/144194
PCT Pub. Date: Aug. 31, 2017

(65) Prior Publication Data

US 2019/0062887 A1 Feb. 28, 2019

(30) Foreign Application Priority Data

Feb. 23, 2016 (DE) ..... 10 2016 202 740.9
Nov. 11, 2016 (DE) ..... 10 2016 222 224.4

(51) Int. Cl.
*C23C 2/20* (2006.01)
*C23C 2/00* (2006.01)
(Continued)

(52) U.S. Cl.
CPC ..... *C23C 2/003* (2013.01); *B65H 23/038* (2013.01); *C23C 2/06* (2013.01); *C23C 2/20* (2013.01);
(Continued)

(58) Field of Classification Search
CPC .. C23C 2/003; C23C 2/20; C23C 2/06; C23C 2/40
See application file for complete search history.

(56) References Cited

U.S. PATENT DOCUMENTS 6,194,022 B1 2/2001 Schunk
6,471,153 B1 * 10/2002 Kimura ..... B65H 23/10 242/419.3
(Continued)

FOREIGN PATENT DOCUMENTS

DE 102005060058 B4 6/2007
DE 102014225516 B3 3/2016
(Continued)

*Primary Examiner* — Hai Y Zhang
(74) *Attorney, Agent, or Firm* — Lucas & Mercanti, LLP; Klaus P. Stoffel

(57) ABSTRACT

A method for operating a coating device for coating a metal strip. The corresponding coating device has an electromagnetic strip-stabilizing device having a plurality of electromagnetic actuators or coils for applying forces to the metal strip. In order to ensure that the strip-stabilizing device is operated only within the operating limits thereof, the magnitudes of the set currents for the actuators or the coils are compared with a specified current threshold value or the forces applied to the metal strip by the actuators are compared with a specified force threshold value and the correction roller is moved into such an adjustment position that the magnitudes of the set currents are below the current threshold value or the magnitudes of the forces are below the force threshold value.

4 Claims, 1 Drawing Sheet

(51) Int. Cl.
*B65H 23/038* (2006.01)
*C23C 2/06* (2006.01)
*C23C 2/40* (2006.01)

(52) U.S. Cl.
CPC ..... *B65H 2301/44332* (2013.01); *C23C 2/40* (2013.01)

(56) References Cited

U.S. PATENT DOCUMENTS

| | | | | |
|---|---|---|---|---|
| 9,551,056 | B2 | 1/2017 | Kurisu et al. | |
| 2004/0241336 | A1 | 12/2004 | Brisberger | |
| 2009/0175708 | A1* | 7/2009 | Lofgren | C23C 2/40 414/222.02 |
| 2010/0285239 | A1* | 11/2010 | Behrens | C23C 2/24 427/595 |
| 2014/0211361 | A1* | 7/2014 | Kurisu | C23C 2/24 361/157 |
| 2017/0268092 | A1 | 9/2017 | Fontaine | |

FOREIGN PATENT DOCUMENTS

| | | | |
|---|---|---|---|
| EP | 0854940 | B1 | 5/2001 |
| EP | 1516939 | A1 | 3/2005 |
| EP | 1794339 | B1 | 7/2011 |
| EP | 2188403 | B1 | 7/2012 |
| EP | 2848711 | A1 | 3/2015 |
| JP | 2002275614 | A | 9/2002 |
| JP | 2003073792 | A | 3/2003 |
| JP | 2003113459 | A | 4/2003 |
| JP | 2003113460 | A | 4/2003 |
| WO | 0214572 | A1 | 2/2002 |
| WO | 03027346 | A1 | 4/2003 |

* cited by examiner

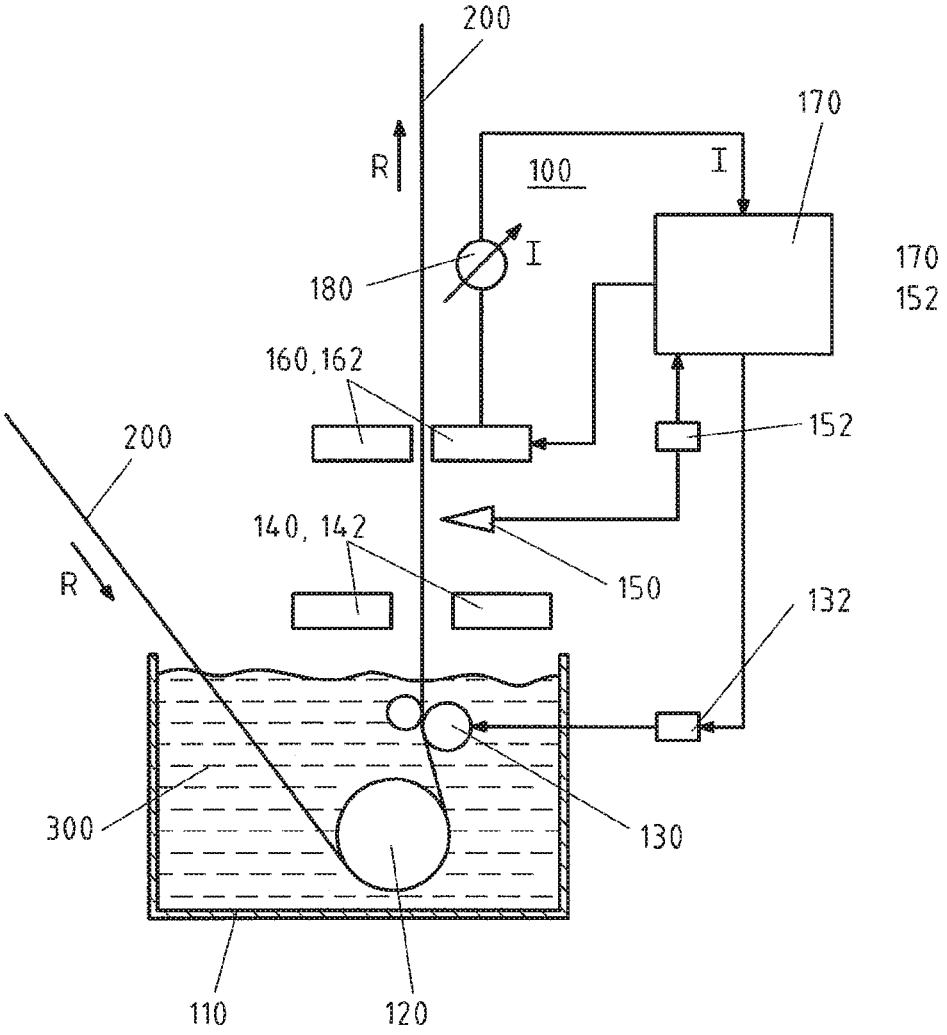
200
170
R
100
I
I
180
170
152
160,162
152
200
140, 142
150
R
132
300
130
110
120

METHOD FOR OPERATING A COATING DEVICE FOR COATING A METAL STRIP, AND COATING DEVICE

The present application is a 371 of International application PCT/EP2017/050660, filed Jan. 13, 2017, which claims priority of DE 10 2016 202 740.9, filed Feb. 23, 2016, and DE 10 2016 222 224.4, filed Nov. 11, 2016, the priority of these applications is hereby claimed and these applications are incorporated herein by reference.

BACKGROUND OF THE INVENTION IDC

The invention relates to a method for operating a coating device for coating a metal strip, for example of a hot-dip galvanizing line for coating the metal strip with zinc.

In such coating devices, in particular in hot-dip galvanizing lines, the thicknesses of the zinc layers currently vary both over the length and over the width of the metal strip. The layer thickness can vary by up to 10 g per m2. Since minimum layer thicknesses have to be guaranteed nowadays, the average layer thickness has to be set such that all the regions of the strip lie above a limiting value. In order to reduce the zinc consumption, there is a desire to reduce the range of fluctuation.

The thickness of the zinc layer is influenced by the setting of a stripping device, i.e. Is influenced decisively with the aid of stripping nozzles. If the distance between the metal strip and the nozzles in the slot of the stripping device fluctuates, then this leads directly to fluctuations in the layer thickness on the metal strip.

Firstly, the distance can fluctuate over the strip width. Secondly, oscillations of the strip in the slot of the stripping device can cause thickness fluctuations over the length of the metal strip.

It is therefore the declared object of every operator of a strip coating device to reduce such oscillations or instabilities of the metal strip as it passes through the coating device, in order in this way to also reduce the variations in the layer thickness on the metal strip associated therewith.

An approach which is usual in the prior art for reducing the oscillations is the provision of an electromagnetic stabilizing device, which is typically connected downstream of the stripping device in the transport direction of the metal strip. Such an electromagnetic stabilizing device is, for example, known from European patent application EP 1 516 939 A1. The strip stabilizing device disclosed there comprises a plurality of magnets in the form of electromagnetic coils on both sides of the coated metal strip. The magnets are arranged in pairs inasmuch as respectively two magnets are opposite each other on both sides of the metal strip. The current with which the coils or magnets are fed is set and controlled on the basis of, for example, the thickness, the speed, the width or internal stresses of the metal strip, with regard to a desired distance between the metal strip and the electromagnets. The distance is measured with the aid of suitable position sensors.

European patent EP 1 794 339 B1 also discloses a coating device for coating a metal strip, wherein the band stabilization is carried out with the aid of electromagnetic coils. Preferably a plurality of coils is arranged beside one another in the width direction of the metal strip, wherein the coils can each also have different currents applied thereto. The method disclosed in EP 1 794 339 B1 provides that, to achieve a previously defined target layer thickness profile on the metal strip, the position of the metal strip within the strip coating device is controlled to a predefined target position value, in that the coils of the strip coating device are operated with a correspondingly suitable current. For the determination of an actual position value for the strip between the opposite coils, required within the context of the position control, instead of a separate position sensor use can also be made of a coil current analyzer, which determines the distance of the metal strip from the coils on the basis of the measured coil current.

Finally, reference should be made to German patent DE 10 2014 225 516 B3, in which, likewise, a coating device for coating a metal strip with an initially still liquid coating material, e.g. zinc, is described. During the coating, the metal strip passes through a roller pair, wherein one of the rollers of the roller pair is adjustable against the other as a correction roller, in order to eliminate possible curvature of the metal strip. The metal strip then runs through a blow-off device for blowing off excess parts of the coating. In order to prevent a non-uniform thickness distribution of the coating on the metal strip, even given adjustment of the correction roller of the roller pair, the actual position of the metal strip is controlled to a predefined central target position in the slot of the blow-off device by means of a suitable displacement of the blow-off device in a plane transverse to the transport direction of the metal strip. An electromagnetic strip stabilizing device is typically arranged above the blow-off device to stabilize the metal strip after leaving the coating container and the blow-off device.

All the described coating devices and methods for coating a metal strip are afflicted by the disadvantage that the electromagnetic strip stabilizing devices are not monitored with regard to electrical overloading. In particular, if attempts are made with the aid of the electromagnetic stabilizing device to set the metal strip to a specific target position between the opposite coils or magnets within the strip stabilizing device and therefore indirectly also to a specific target position in the slot of the stripping device, considerable forces can be needed for the purpose, which in turn require very high currents in the coils of the strip stabilizing device.

The Japanese publication JP 2003-113460 A discloses a method and device for coating a metal band In particular, this reference teaches holding the currents of the electromagnets in the electromagnetic stabilizing device below a predetermined limit value.

SUMMARY OF THE INVENTION

The Invention Is therefore based on the object of further developing a known method and a known coating device for coating a metal strip to the effect that a mechanical overloading of the strip stabilizing device and in particular the actuators or coils within the strip coating device during the operation of the latter is reliably prevented.

In terms of the method, this object is achieved by the following steps:

comparing the magnitude of the forces exerted on the metal strip by the actuators with a predefined force threshold value;

and moving the correction roller into an adjustment position such that the magnitudes of the forces lie below the force threshold value; and converting the actual position of the metal strip measured by the distance sensors, which are arranged between the stripping device and the trip stabilizing device and/or within the strip stabilizing device, to the actual position of the metal strip within the slot of the stripping device.

The target position for the metal strip is predefined in the slot of the stripping device. The measurement of the actual position of the metal strip is then ideally carried out directly in the slot of the stripping device with the aid of distance sensors fitted there. The environmental conditions in the slot of the stripping device are, however, generally unsuitable for a non-contact position measurement. Therefore, the distance sensors are arranged between the stripping device and the strip stabilizing device and/or within the strip stabilizing device. These distance sensors measure the actual position of the metal strip outside the slot of the stripping device. This means only indirect measurement of the actually sought-after actual position of the metal strip within the slot of the stripping device. Therefore, in the case of the indirect measurement, a conversion device is required to convert the position of the metal strip measured by the distance sensors to the sought-after actual position of the metal strip within the slot of the stripping device.

The present invention claims position control for the metal strip. The setting of the currents is typically carried out continuously within the context of the control.

According to a first exemplary embodiment, the position control comprises the following part steps: directly or indirectly measuring the actual position of the metal strip with the aid of distance sensors, which are arranged between the stripping device and the strip stabilizing device and/or within the strip stabilizing device; comparing the actual position of the metal strip with the predefined target position of the metal strip for the purpose of determining a possible position control deviation as a difference between the target and the actual position; and setting currents of the actuators such that the position control deviation comes as close as possible to zero and therefore the target position is as far as possible achieved.

Within the context of the position control, the determined position control deviation is fed to the control system, i.e. the controller, as an input variable. The control system calculates suitable actuating signals for actuating members on the basis of the position control deviation, such that the position control deviation comes as close as possible to zero. The present invention provides two actuating members, namely the setting of the currents of the actuators or the coils and the correction roller. The primary actuating member is the currents; i.e. the position control is carried out primarily and preferably continuously via the setting of the currents.

Only when the magnitudes of the currents reach the operating limits of the strip stabilizing device or the coils does the invention provide for an adjustment of the correction roller to be carried out as well. The adjustment of the correction roller likewise contributes to the position control of the metal strip, in that it effects at least coarse pre-setting or pre-adjustment of the metal strip to the target position. As a result, the remaining correction effort for the coils becomes lower. This means that only still smaller forces and therefore only still smaller currents are needed for the coils in order to transfer the metal strip to the target position. The currents are therefore used with priority over the correction roller as an actuating member, since they can be set and act substantially more quickly than the correction roller.

The present invention offers the advantage that the currents which are applied to the actuators, i.e. the electromagnetic coils within the strip stabilizing devices, always lie within their operating limits. This is ensured by appropriate adjustment of the correction roller. This is advantageous in particular during product changes since then, for example, the thicknesses or the yield strengths of the material of the new metal strip to be coated can change, which possibly makes it necessary to apply greater forces within the strip stabilizing device. To this extent, the present invention reliably ensures that the strip stabilizing device is operated only within its electronic and mechanical limits even during a product change.

The method and/or the adjustment of the correction roller is typically carried out automatically.

According to a further exemplary embodiment of the method according to the invention, the set currents of the actuators in the adjustment position of the correction roller, the forces on the metal strip in the adjustment position of the correction roller and/or the adjustment position of the correction roller are stored, for example in a storage device or a cloud, preferably classified in accordance with the steel grade of the metal strip, the temperature of the coating medium in the container, the temperature of the metal strip, the thickness of the metal strip, the width of the metal strip and/or the yield strength of the material of the metal strip.

Storage offers the advantage that, during a later product change when a same type of metal strip is then again about to be coated, the stored values can already be used as good starting values for the currents of the actuators or the position of the correction roller. By means of the good starting values, possible shape or position control deviations can already be partly pre-compensated.

The aforementioned object is further achieved by a coating device according to the invention. The advantages of this solution correspond to the advantages mentioned above with reference to the claimed method.

BRIEF DESCRIPTION OF THE DRAWING

Appended to the description is a FIGURE which illustrates the structure of the coating device according to the invention. The invention will be described in detail below with reference to this FIGURE in the form of exemplary embodiments.

DETAILED DESCRIPTION OF THE INVENTION

The FIGURE shows a coating device 100 for coating a metal strip 200 with an initially still liquid coating medium 300. The coating device 100 can be, for example, a hot-dip galvanizing device for coating the metal strip 200 with zinc. The coating device 100 has a container 110 which, during operation, is filled with the liquid coating medium 300. Arranged in the container 110 is a pot roller 120, i.e. a deflection roller, for deflecting the metal strip 200 into a typically vertical exit direction. The transport direction of the metal strip is designated by the designation R. Following its exit from the container 110, the metal strip 200 with the adhering initially still liquid coating medium passes through a stripping device 140 having nozzles 142 for blowing excess coating medium off the metal strip. To stabilize the metal strip, the metal strip passes through an electromagnetic strip stabilizing device 160 having a plurality of electromagnetic actuators 162, typically coils. The coils are arranged on both sides of the metal strip to apply forces to the metal strip 200. In the FIGURE, by way of example the strip stabilizing device 160 is arranged downstream of the stripping device 140 in the transport direction R of the metal strip 200. The coating device 100 also has distance sensors 150 for the direct or indirect measurement of the actual position of the metal strip 200 within the stripping device 140. A control device 170 is provided to receive the position signals generated by the distance sensors 150, which represent the position of the metal strip at the location of the measurement, and the currents of the coils 162 within the strip stabilizing device 160, measured with the aid of an ammeter 180. The control system 170 is also designed to emit output signals to the strip stabilizing device 160 for the individual adjustment of the currents of the coils, and to emit an output signal to an actuator 132 to adjust or move the correction roller 130.

According to the invention, the said coating device 100 is operated as follows:

Firstly, the actual position of the metal strip 200 in the slot of the stripping device 140 is measured directly or indirectly with the aid of the distance sensors 150. The term "direct measurement" assumes that the distance sensors 150 are actually arranged within the stripping device 140 and monitor the slot there. Typically, the measurement of the actual position of the metal strip in the slot of the stripping device 140 is carried out indirectly, however, in that the actual position of the metal strip 200 is measured outside the stripping device 140 with the aid of the distance sensors and then, with the aid of a conversion device 152, is converted to the actual position within the stripping device 140. If only coarse measurement of the actual position of the metal strip in the slot of the stripping device 140 is required, and in particular if the distance sensors 150 are not arranged within the stripping device 140 but very closely adjacent to the latter, it is also possible to dispense with the aforesaid conversion device.

The method according to the invention then further provides for the measured actual position of the metal strip to be compared with a predefined target position in the slot of the stripping device 140 for the purpose of determining a possible position control deviation. The metal strip is then positioned within the slot of the strip stabilizing device by adjusting suitable currents of the actuators such that the position control deviation comes as close as possible to zero. It may be necessary for considerable forces to be applied to the metal strip, which require correspondingly high currents in the actuators or coils 162 of the strip stabilizing device 160.

In order to prevent these forces and currents exceeding the operating limits of the strip stabilizing device 160, the invention provides for the magnitudes of the set currents to be compared with a predefined current threshold value, or for the forces exerted on the metal strip by the actuators 162 to be compared with a predefined force threshold value, and for the correction roller 130 to be moved with the aid of the control system 170 to such an adjustment position that the magnitudes of the set currents lie below the current threshold value or the magnitudes of the forces lie below the force threshold value. In this way, it is ensured that the operating limits of the strip stabilizing device 160 are not exceeded.

LIST OF DESIGNATIONS

100 Coating device
110 Container
120 Pot roller
130 Correction roller
132 Actuator for correction roller
140 Stripping device
142 Nozzle
150 Distance sensors
152 Conversion device
160 Strip stabilizing device
162 Actuators or coils of the strip stabilizing device
170 Control system
180 Current measuring device or ammeter
200 Metal strip
300 Coating medium
R Transport direction of the metal strip

The invention claimed is:

1. A method for operating a coating device for coating a metal strip, wherein the coating device has a container for a liquid coating medium, a pot roller arranged in the container for deflecting the metal strip, a correction roller for adjustment against the metal strip after passing the pot roller, a stripping device having nozzles for blowing excess coating medium off the metal strip after the metal strip exits from the container, distance sensors for measuring the actual position of the metal strip after leaving the container and a strip stabilizing device arranged downstream of the stripping device in a transport direction of the metal strip, having a plurality of electromagnetic actuators for applying forces to the metal strip, wherein the method comprises the steps of:

controlling a position of the metal strip to a predefined target position in a slot of the stripping device by way of correspondingly suitable setting of currents of the plurality of electromagnetic actuators;

predefining a force threshold value to represent an operating limit of the strip stabilizing device;

comparing magnitudes of the forces exerted on the metal strip by the plurality of electromagnetic actuators with the predefined force threshold value to prevent the forces exerted on the metal strip from exceeding the operating limit of the strip stabilizing device;

moving the correction roller to an adjustment position so that the magnitudes of the forces lie below the force threshold value; and converting the actual position of the metal strip measured by the distance sensors, which are arranged between the stripping device and the strip stabilizing device and/or within the strip stabilizing device, to the actual position of the metal strip within the slot of the stripping device.

2. The method according to claim 1, wherein the step of controlling the position of the metal strip includes:

measuring the actual position of the metal strip using the distance sensors, comparing the actual position of the metal strip with the predefined target position of the metal strip for determining a possible position control deviation as a difference between the target position and the actual position; and setting currents of the plurality of electromagnetic actuators so that the position control deviation comes as close as possible to zero and therefore the target position is as far as possible achieved.

3. The method according to claim 1, further including storing the set currents of the plurality of electromagnetic actuators in the adjustment position of the correction roller, the forces on the metal strip in the adjustment position of the correction roller and/or the adjustment position of the correction roller.

4. The method according to claim 3, wherein the storing strep includes classifying in accordance with steel grade of the metal strip, temperature of the coating medium in the container, temperature of the metal strip, thickness of the metal strip, width of the metal strip and/or yield strength of the material of the metal strip.

* * * * *